US008397644B2

(12) United States Patent
Aschauer et al.

(10) Patent No.: US 8,397,644 B2
(45) Date of Patent: Mar. 19, 2013

(54) STORAGE AND RETRIEVAL MACHINE

(75) Inventors: Herbert Aschauer, Wels (AT); Ronald Fessl, Wels (AT)

(73) Assignee: Swisslog Evomatic GmbH, Sipbachzell (AT)

( * ) Notice: Subject to any disclaimer, the term of this patent is extended or adjusted under 35 U.S.C. 154(b) by 0 days.

(21) Appl. No.: 12/555,098

(22) Filed: Sep. 8, 2009

(65) Prior Publication Data

US 2010/0058950 A1 Mar. 11, 2010

(30) Foreign Application Priority Data

Sep. 8, 2008 (AT) ..... A 1392/2008
Oct. 2, 2008 (AT) ..... GM 552/2008 U

(51) Int. Cl.
*B61B 13/04* (2006.01)

(52) U.S. Cl. ..... 105/141; 414/630; 414/277; 104/118; 104/121

(58) Field of Classification Search ..... 104/173.1, 104/172.3, 176, 118, 119, 124, 127, 128, 104/139, 245, 246, 247, 93–95; 105/141, 105/144, 145, 146; 414/630
See application file for complete search history.

(56) References Cited

U.S. PATENT DOCUMENTS

| | | | | |
|---|---|---|---|---|
| 7,281,608 | B2 * | 10/2007 | Hansl et al. | 187/226 |
| 2004/0216957 | A1 * | 11/2004 | Hansl et al. | 187/247 |
| 2010/0058950 | A1 * | 3/2010 | Aschauer et al. | 105/141 |
| 2010/0068022 | A1 * | 3/2010 | Aschauer et al. | 414/630 |

FOREIGN PATENT DOCUMENTS

| | | | |
|---|---|---|---|
| DE | 19534291 | A1 * | 3/1997 |
| DE | 19534291 | C2 | 3/1997 |
| EP | 1 061 035 | A2 | 12/2000 |

* cited by examiner

*Primary Examiner* — Jason C Smith
(74) *Attorney, Agent, or Firm* — Ladas & Parry LLP

(57) ABSTRACT

Storage and retrieval machine with a chassis (9) for supporting a mast (10), comprising at least one carriage (1) including guide elements (2, 2'), at least one drive element (3) assigned to the carriage (1) and including a drive motor (5), and with at least one rail (4) assigned to the carriage (1), wherein at least a partial area, seen in the installation orientation, directly above the rail (4) is free of guide elements (2, 2').

14 Claims, 3 Drawing Sheets

STORAGE AND RETRIEVAL MACHINE

This invention concerns a storage and retrieval machine with a chassis for supporting a mast, comprising at least one carriage including guide elements, at least one drive element assigned to the carriage and including a drive motor, and with at least one rail assigned to the carriage.

Storage and retrieval machines according to the state of the art are for example described in the documents DE 195 34 291 A1 and EP 1 061 035 A2, wherein guide elements, especially track rollers of a chassis, are positioned on the flange surface closer to the mast, e.g. on the rail's head, so that the chassis is substantially guided above the rail.

Usually, the drive element, e.g. in the form of a drive belt, is positioned next to the rail for guiding the carriage so that a special resting surface has to be provided, which requires corresponding space and has to be suitable for this purpose. Such an off-centered guidance of the drive element results in a disadvantageous stress on the chassis.

Furthermore, the known track roller arrangement results in a relatively large length of the carriage, which is disadvantageous for the utilization of warehouse dimensions. A further disadvantage is the large weight of known storage and retrieval machines, which results in high energy costs.

Finally, in known storage and retrieval machines the rail for guiding the carriage consists of several elements that are welded at contact points because there is no other possible form of joining when the track rollers are guided on the top surface of the rail profile. Since the weldings have to be renewed after some time, undesired idle times arise.

Consequently, one object of the invention is to create a chassis that is small, light and as compact as possible and that optimally directs the static and dynamic forces occurring during the operation of a storage and retrieval machine into a rail or the ground.

A further object of the invention is to provide a storage and retrieval machine with a short design that allows a high warehouse utilization ratio due to the reduction of approach dimensions.

Furthermore, a storage and retrieval machine is to be created, the structure of which allows the provision of reliable and durable rail joints.

According to the invention, this is solved by keeping at least a partial area—seen in the installation orientation—directly above the at least one rail free of guide elements.

This free space directly above the rail creates the possibility to arrange the drive elements so that a direct, torque-free transfer of forces, especially drive forces, into the rail is guaranteed. This allows the drive element to be guided centrically and directly above the rail.

The partial area above the rail kept free of guide elements of the carriage allows the drive element to be guided directly above and along the rail, i.e. a course thereof close to the rail and centric, so that the acting drive forces do not cause moments in the carriage, no special resting surface has to be created, and mounting of the drive element is simplified. Access to the chassis is made easier for maintenance personnel because the stumbling edge arising from conventional drive element guidances is not present anymore.

Overall, the centric arrangement of the drive element results in a centric traction and thus low wheel pressures at the lateral guide rollers provided and no torsional load in the chassis.

Furthermore, no further dowelling of the tension stations for the drive element on the floor is necessary since clamping at the head of the rail is possible. Also, exact laying allows the creation of an exact laying area for the drive belt without further efforts.

A further consequence of the inventive arrangement of the guide elements consists in that the rail joints can be permanently screwed or clamped so that no weld is necessary.

Furthermore, the carriage of the inventive storage and retrieval machine is, for the main part, not arranged above the rail but on both sides of the rail, which allows a compact design.

Generally, drive motors and control units for driving the drive element are arranged on the carriage. Omission of the carrying wheels arranged on the rail has the advantage that access to the control box of the storage and retrieval machine is facilitated strongly because—due to the low position of the, for example, control box—no mounting aids, safety devices to prevent falling etc. are required. Furthermore, due to the small overall chassis length and height of the storage and retrieval machine, approach dimensions are reduced and the warehouse volume utilization ratio is increased.

A possible embodiment of the inventive storage and retrieval machine may consist in that the guide elements bearing vertical loads are guided on interior surfaces of the rail facing each other.

Guiding the guide elements on surfaces facing each other allows a better bearing of vertical forces acting thereon.

According to another variation, it may be provided that at least one first guide element of the carriage is guided on a first interior surface of a first flange of the at least one rail, and at least one second guide element of the carriage is guided on a second interior surface of a second flange of the at least one rail, which second interior surface of the second flange faces the first interior surface of the first flange.

The suitable flange surfaces of the rail allow a constructionally simple guidance of the guide elements on the rail interior surfaces and keeping free the top outer surface of the rail for resting the drive element.

In addition to the guide elements, which can be guided on the surfaces of the flanges facing each other, further guide elements may be arranged, for example to optimize the tracking of the chassis or the transfer of the loads onto the rail.

According to the present invention, the rail may have a polygonal cross section. A preferred variation is that the rail has the cross section of an I-beam.

The rail for guiding the chassis of a storage and retrieval machine experiences various stresses due to, for example, the weight of the chassis, the mast and the cargo cage themselves or to the deceleration and acceleration of the storage and retrieval machine. Because of the plurality of possible stresses, a possible optimization of the cross section with regard to the occurring stresses is part of the embodiment of the chassis of the inventive storage and retrieval machine.

Rails with an I-shaped cross section, which are most often used for storage and retrieval machines, can also be used according to the present invention.

A further embodiment of the inventive storage and retrieval machine could be that at least one of the guide elements is a track roller.

The guidance of track rollers on, for example, the surface on the web side of a flange of a rail with a I-shaped cross section requires rollers with a small diameter. This can only be implemented when the whole storage and retrieval machine, especially the mast of the storage and retrieval machine, is constructed in a sufficiently light design.

In one variation of the inventive storage and retrieval machine, four track rollers are guided along the interior side of the head as first surface of a rail flange, and four track rollers are guided on the interior side of the foot as second surface of a rail flange. Transfer of the loads, mostly the weight of the mast, the chassis and the load element themselves, into the ground occurs via the carrying wheels that are guided along the foot of the rail. The running surface for these carrying wheels, especially in the area of the rail joint, can be easily adjusted via clamped foot bottom parts. Those carrying wheels that are guided on the interior surface of the head of the rail only serve for transferring the starting and braking torques of the chassis into the rail.

The inventive arrangement of the carrying wheels as guide elements has the advantage that welding at the rail joint is not absolutely necessary. The rail joint may be created by means of a plate, which is screwed and/or clamped onto the flange surface that the carrying wheels are not driven on. Compared to a welded rail joint, the screwed joint has a higher fatigue limit.

A further embodiment of the inventive storage and retrieval machine may be that at least one of the guide elements is a slide element.

Furthermore, track rollers and slide elements as well as any combination thereof can be used as guide elements according to the invention.

A preferred embodiment of the inventive chassis of a storage and retrieval machine may be that a drive element assigned to a respective carriage is arranged in at least partial areas, in the installation orientation, directly above the rail longitudinal axis.

Guidance of the carriage along interior parts of the rail profile creates a free space on the top side of the rail. Arranging the drive element within this free space, in particular directly above the rail, has the effect that an off-centric stress of the carriage as with known arrangements is avoided. With regard to the dynamic movements of a storage and retrieval machine, especially regarding quick acceleration and deceleration; a minimization of off-centric stress has a very positive effect on the operating time of wearing parts.

A preferred embodiment may be that the drive element is at least one drive belt. The invention also comprises that the drive element is, at least in partial areas, restable, seen in the installation orientation, on the rail, particularly on a partial area of the, in installation orientation, upper flange surface of the rail.

Due to the dynamics of the storage and retrieval machine, especially due to the quick acceleration and deceleration of the whole storage and retrieval machine, a drive belt is a very suitable drive element. Furthermore, the drive belt has, in the embodiment of the inventive chassis, especially with regard to the guidance of the guide elements along the flange surface on the web side, the advantage that the drive belt can, at least in partial areas, be supported on the rail. Since the carriage follows the exactly straight rail course, further means such as the arrangement of belt rests on the ground or of lateral belt rests for guiding or tensioning the belt are not necessary. Also, the drive belt may simply be attached to the ends of the rail.

Contrary to lateral belt rests, a belt resting on the rail does not constitute a stumbling spot for e.g. workers.

It has proven advantageous to drive the carriage with an omega drive.

According to the present invention, it shall not be precluded that the chassis of the storage and retrieval machine is driven by other means known to a person skilled in the art or any combination of such means.

The embodiment of the inventive chassis may be characterized in that the drive motor is arranged on the carriage centrically above the rail.

Guidance of the drive element and arrangement of the drive motor outside the rail axis create an eccentricity of the drive force towards the rail. In the embodiment of the inventive chassis of a storage and retrieval machine, such a off-centric stress is avoided by positioning the drive above the rail. The latter is especially advantageous with regard to the wear and thus the life of the guide elements of the carriage.

In the following, the invention is described in detail by referring to the exemplary embodiments shown in the drawings. Herein, FIG. 1 is a schematic lateral view of an embodiment of the inventive storage and retrieval machine, in part cut vertically parallel to the movement direction of the chassis.

Figure 1:
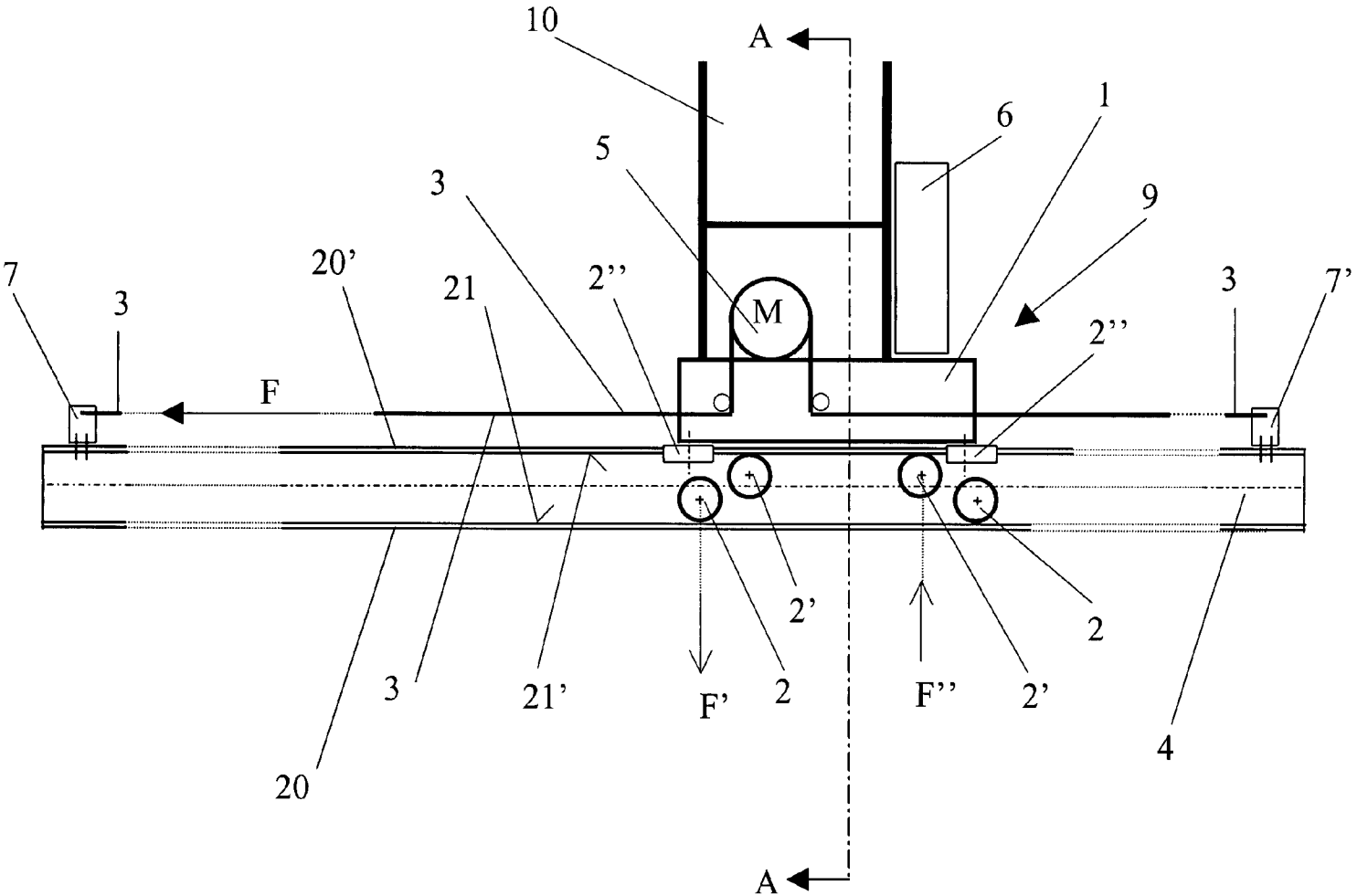

FIG. 1 shows a storage and retrieval machine with a chassis 9 for supporting a mast 10, comprising a carriage 1 including guide elements 2, 2', a drive element 3 assigned to the carriage 1 and including a drive motor 5, and with a rail 4 assigned to the carriage 1, wherein according to the invention a partial area, seen in the installation orientation, directly above the rail 4 is free of guide elements 2, 2'.

The guide elements 2, 2' mainly discharge vertical loads, the guide elements 2 guided below essentially carrying the weight of the carriage 1 with the mast 10 erected thereon, and the guide elements 2' guided above absorbing the forces occurring during accelerations of the carriage 1.

In the exemplary embodiment shown, the area directly above the top outer surface of the rail 4 is kept free along its complete length and does thus not serve as guide area for guide elements but as resting surface for the longitudinal drive element 3, which can for example be provided in the form of a drive belt.

The guide elements 2, 2' bearing vertical loads are essentially guided below the head of the rail 4 in an interior area thereof on interior surfaces 21, 21' facing each other.

Figure 2:
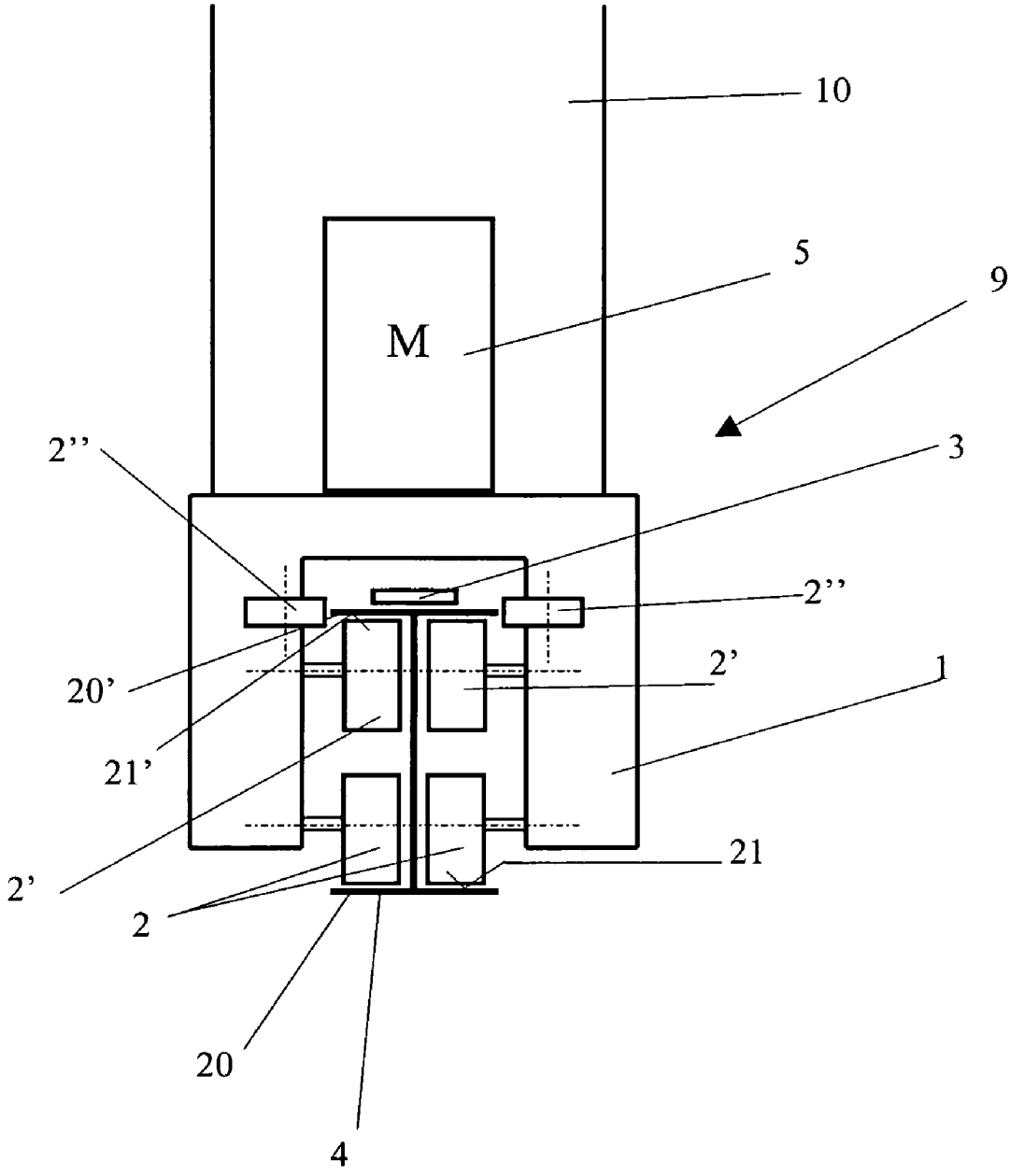
FIG. 2 is a schematic cut along the line AA through the storage and retrieval machine according to FIG. 1, wherein the section is vertically transverse to the movement direction of the chassis.

FIG. 2 shows, without limiting the generality of the exemplary embodiments, the profile of a rail 4 having a polygonal cross section and formed as an I-shaped beam. Rail profiles with other shapes may also be used.

Altogether four first guide elements 2 of the carriage 1, which are provided as track rollers in the exemplary embodiment shown, are guided on a first lower interior surface 21 of a first flange 20 of the rail 4, each two of these being arranged in line along one axis.

Accordingly, four second guide elements 2' of the carriage 1 are arranged on a second upper interior surface 21' of a second flange 20' of the rail 4, which second surface 21' of the second flange 20' faces the first surface 21 of the first flange 20.

The number and position of the guide elements 2, 2' can be varied within the scope of the invention. Essential for the invention is an arrangement in which none of these guide elements 2, 2' is guided on the top surface of the rail 4, in order to allow a centric guidance of the drive element 3, which results in substantial constructional advantages.

Preferably, the guide elements 2 are separated into double pairs and mounted on an assigned bow (not shown). This guarantees that the vertical forces introduced are evenly distributed among the individual track rollers of the double pairs of the guide elements 2, even if this results in a slight bending of the carriage 1 due to the stress.

Due to the limited space in the area of the rail 4 and the stresses occurring, this embodiment very often makes it possible for the first time to reach the demanded life span despite small roller diameters.

The guiding elements 2 are preferably arranged in the area directly below the mast and the guide elements 2' each adjacent outside of this area in order to reach the respectively optimal discharge of the loads into the rail 4.

As shown in FIG. 2, the carriage 1 has, in a built-in state, lateral walls extending downwards on opposing sides of the rail 4, in which the bearings of the guide elements 2, 2' are received.

The lateral guidance of the chassis 9 is effected by lateral guide elements 2", which introduce no vertical, but exclusively horizontal forces into the rail 4. They may also be mounted in a different position than shown. For example, the lateral guide elements 2" may also be provided on the foot or the web of the rail 4.

On the carriage 1, the mast 10 is attached by means of screwings. The mast 10, which serves for example for receiving a lift carriage not shown, can be moved back and forth on the carriage 1 along the rail 4. The vertical motion axis of the storage and retrieval machine thus extends along the mast 10, while the horizontal motion axis of the storage and retrieval machine extends along the rail 4.

On the carriage 1, a control box 6 is located preferably outside the mast 10. Since the guide elements 2, 2' are guided at the same height as the rail 4, the carriage 1 is located low so that the control box 6 is easily accessible and consequently no further constructional measures such as mounting means, platforms and optionally safety devices to prevent falling are necessary.

As mentioned above, the drive motor 5 is also positioned on the carriage 1 and which moves the carriage 1 via the drive element 3, usually a drive belt. The drive element 3 is attached to the ends of the rail 4 by means of fixing elements 7, 7'.

By guiding the drive element 3 directly close to the top side of the rail 4, the unequal loads F', F" of the guide elements at a traction force F are minimized. Also, a resting of the drive element 3 is advantageous insofar as it does not have to be supported and guided by any further means. Consequently, no further additional means for attaching the drive element 3 to the rail end are necessary.

As shown in FIG. 2, the drive element 3 is guided centrically and directly above the rail 4 and the flange 20', respectively, in order to avoid stress on the lateral guide elements 2" due to the traction force applied. Since the guide elements 2, 2' of the carriage are guided below the flange 20', an advantageous arrangement of the drive element 3 directly above the rail 4 is possible.

The drive motor 5 is arranged directly above the rail 4 and the drive element 3, which avoids eccentric stress on the rail 4 due to the drive force F.

Figure 3:
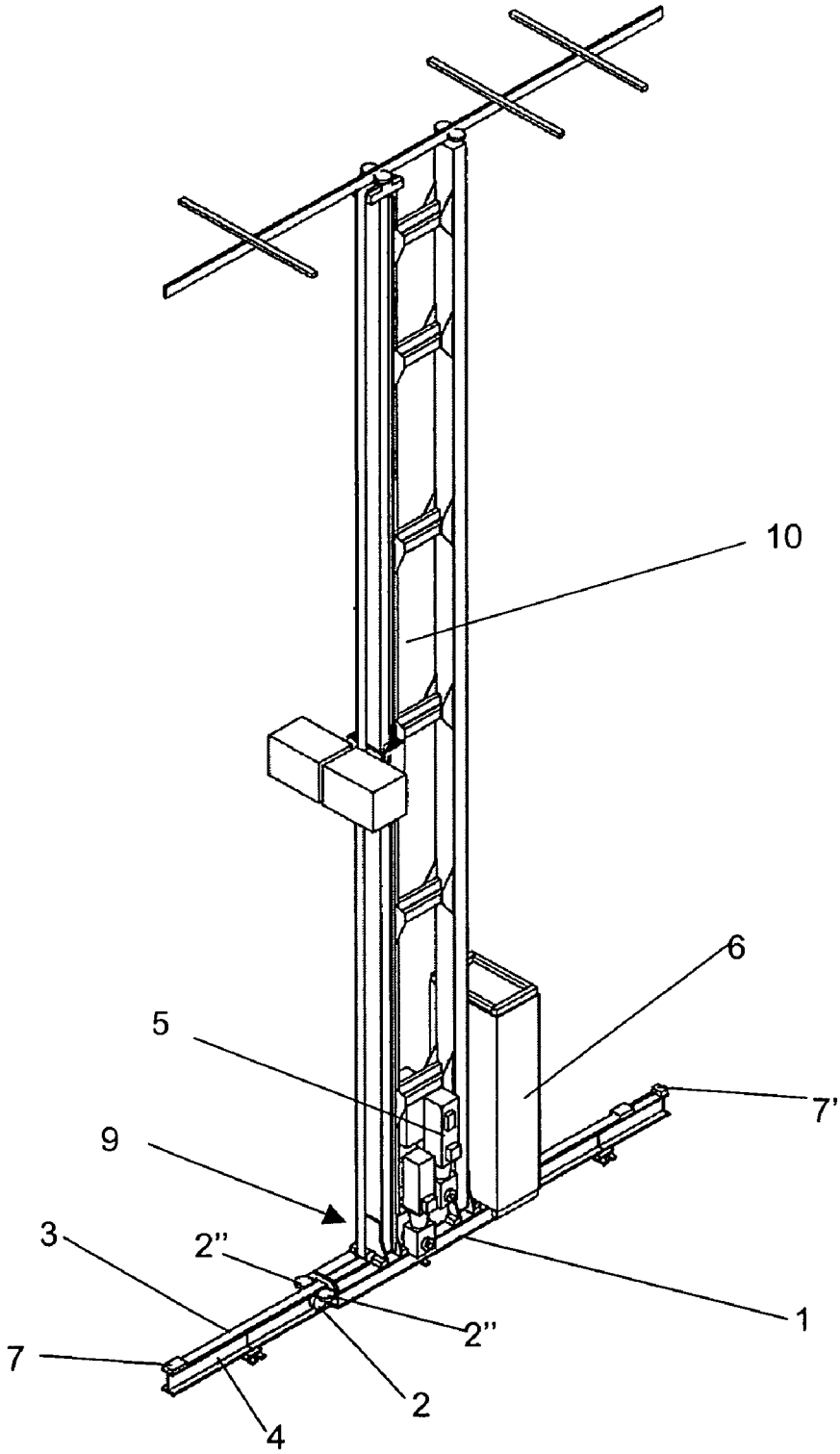
FIG. 3 is a three-dimensional representation of a further embodiment of the inventive storage and retrieval machine.

FIG. 3 shows an embodiment of the invention where the chassis 9 in connection with a mast 10 with a lightweight design is preferably formed of edged Al profiles that are screwed together to form two closed longitudinal beams with a shaped-tube cross section. In case of a more solid design of the mast 10, the chassis 9 may also be formed of materials with higher strength such as steel.

The guide elements 2, 2' move in the interior of the profile of the rail 4 and are either mounted onto the rail 4 in situ together with the carriage 1 or may, if required, be introduced therein on the front end.

The invention claimed is:

1. Storage and retrieval machine comprising a chassis for supporting a mast, comprising a carriage including guide elements, at least one moveable drive element assigned to the carriage and a drive motor, which drive motor is positioned on the carriage, is in driving engagement with the at least one moveable drive element and moves the carriage by means of the at least one moveable drive element, and at least one rail assigned to the carriage, the at least one moveable drive element being positioned next to the at least one rail, wherein an area directly above the at least one rail is free of guide elements so that the area directly above the top outer surface of the rail is kept free along its complete length and does not serve as guide area for guide elements but as resting surface for the at least one moveable drive element, and that the at least one moveable drive element is guided centrically and directly above the rail, and that the guide elements bearing vertical loads are essentially guided below the upper edge of the at least one rail.

2. Storage and retrieval machine according to claim 1 wherein the guide elements are at least partially guided in an interior area of the at least one rail.

3. Storage and retrieval machine according to claim 2, wherein the guide elements are guided on interior surfaces of the at least one rail facing each other.

4. Storage and retrieval machine according to claim 3, wherein at least one first guide element of the carriage is guided on a first interior surface of a first flange of the at least one rail, and at least one second guide element of the carriage is guided on a second interior surface of a second flange of the at least one rail, which second interior surface of the second flange faces the first interior surface of the first flange.

5. Storage and retrieval machine according to claim 1, wherein the guide elements are separated into double pairs and mounted on an assigned bow.

6. Storage and retrieval machine according to claim 1, wherein the carriage has, in a built-in state, lateral walls extending downwards on opposing sides of the at least one rail, in which the bearings of the guide elements are received.

7. Storage and retrieval machine according to claim 1, wherein the at least one rail has a polygonal cross section.

8. Storage and retrieval machine according to claim 1, wherein the at least one rail has the cross section of an I-beam.

9. Storage and retrieval machine according to claim 1, wherein at least one of the guide elements is a track roller.

10. Storage and retrieval machine according to claim 1, wherein at least one of the guide elements is a slide element.

11. Storage and retrieval machine according to claim 1, wherein a drive element assigned to a respective carriage is arranged in at least partial areas, in the installation orientation, directly above the rail longitudinal axis.

12. Storage and retrieval machine according to claim 1, wherein the drive element is at least one drive belt.

13. Storage and retrieval machine according to claim 1, wherein the drive element is, at least in partial areas restable—seen in the installation orientation—on the rail, particularly on a partial area of the, in installation orientation, upper flange surface of the at least one rail.

14. Storage and retrieval machine according to claim 1, wherein the drive motor is arranged on the carriage approximately centrically above the at least one rail.

* * * * *